US005740947A

United States Patent [19]

Flaig et al.

[11] Patent Number: 5,740,947

[45] Date of Patent: Apr. 21, 1998

[54] DUAL COMPARTMENT PUMP DISPENSER

[75] Inventors: Raymond Michael Flaig; James Lynn Turbett, both of Stamford; Peter Bertolini, Shelton, all of Conn.

[73] Assignee: Chesebrough-Pond's USA Co., Division of Conopco, Inc., Greenwich, Conn.

[21] Appl. No.: 645,395

[22] Filed: May 13, 1996

[51] Int. Cl.[6] ..... B67D 5/52

[52] U.S. Cl. ..... 222/135; 220/23.4; 222/143

[58] Field of Search ..... 222/94, 129, 134, 222/135, 137, 144.5, 143, 321.1, 321.7, 321.9; 220/23.4, 23.83; D9/300, 341; 215/10

[56] References Cited

U.S. PATENT DOCUMENTS

| | | | |
|---|---|---|---|
| D. 313,347 | 1/1991 | Fiore | D9/341 |
| 3,187,757 | 6/1965 | Jones, Jr. et al. | 222/143 X |
| 3,269,389 | 8/1966 | Meurer et al. | 222/135 X |
| 4,687,663 | 8/1987 | Schaeffer | 222/94 X |
| 4,826,048 | 5/1989 | Skorka et al. | 222/135 X |
| 5,038,963 | 8/1991 | Pettengill et al. | 222/137 X |
| 5,158,191 | 10/1992 | Douglas et al. | 222/143 X |
| 5,252,312 | 10/1993 | Gentile et al. | 222/94 X |
| 5,316,159 | 5/1994 | Douglas et al. | 222/143 X |

FOREIGN PATENT DOCUMENTS

| | | | |
|---|---|---|---|
| 3142205 | 5/1983 | Germany | 222/144.5 |
| 3911 089 | 4/1989 | Germany . | |
| 9301506 | 4/1995 | Netherlands . | |

*Primary Examiner*—Kevin P. Shaver
*Attorney, Agent, or Firm*—Milton L. Honig

[57] ABSTRACT

A dual compartment pump dispenser is provided which includes a first and second container with a pair of independent pump mechanisms each for emptying product through a respective dispensing nozzle. The dispensing nozzles have openings oriented in a direction at least 60° apart from one another, preferably 180° apart. Different compositions are intended to be stored in each container for sequential rather than simultaneous use. The containers are joined along a sinusoidal curvilinear surface having complementary mating elongated recesses and ridges. A collar and base cup fasten the containers together.

23 Claims, 4 Drawing Sheets

DUAL COMPARTMENT PUMP DISPENSER

BACKGROUND OF THE INVENTION

1. Field of the Invention

The invention concerns a dual compartment pump dispenser for separately storing different compositions intended for non-simultaneous delivery.

2. The Related Art

Multi-compartment dispensers are well known. Although expensive, there is resort to multi-compartment packaging when ingredients of a formulation are storage unstable in the presence of one another. For instance, U.S. Pat. No. 4,871,663 (Schaeffer) and U.S. Pat. No. 5,038,963 (Pettengill et al.) utilize dual compartment pumps for separate storage of bicarbonate and peroxide toothpaste components. The systems are intended to simultaneously dispense ribbons containing each of the active ingredients for placement onto a toothbrush. Of particular relevant to the present invention are U.S. Pat. No. 5,158,191 and U.S. Pat. No. 5,316,159, both to Douglas et al., describing a container with dual bottles releasably interlocked together inside-by-side relation. A single cap covers both bottles. Independently openable separate outlets for each of the bottles are formed on the cap.

The problem sought to be solved by the present invention is delivery of two formulations in a sequential rather than simultaneous manner. One product area requiring sequential application is that of cosmetic skin treatment regimes. Two or more different compositions are employed in these regimes and applied to the skin in sequential order. These treatments may serially employ a cleanser, moisturizer, toner and finally facial foundation.

A co-pending patent application to Suares et al., Ser. No. 08/451,940, describes the need for a system to deliver actives to both prevent skin damage and also correct same. It was suggested that separate compositions be formulated for the prevent and correct segments of a treatment regime. Each of these compositions would then require respective timing for application to skin. Prevention compositions utilizing sunscreens as actives would be utilized for daytime use. Correction compositions would be for nighttime use. The latter would incorporate actives such as alpha-hydroxy carboxylic acids.

When a skin treatment regime requires multi-composition use, there have been problems with consumer education and discipline. Education is particularly a problem in mass market outlets where a cosmetic knowledgeable sales staff is generally absent. A customer may purchase one product in a treatment regime but may be uninformed with respect to a necessary complementary regime product. Even a somewhat educated customer may select the wrong complementary product. Most frustrating is when a totally educated customer discovers that the store either does not carry the complementary product or is temporarily out of stock.

Accordingly, it is an object of the present invention is to provide a dispensing system particularly suitable for cosmetic regimes but also applicable to a wide variety of other cosmetics and products including foods, adhesives and detergents.

It is another object of the present invention to provide a dispensing system for a multi-composition product, especially for a skin treatment regime, that ensures the recommended compositions are all provided to the consumer in a single sale.

Still another object of the present invention is to provide a dispensing system for a product, especially a skin treatment regime, that daily serves as a remainder to the consumer as to the proper utilization of component compositions.

Yet another object of the present invention is to provide a dispensing system for a variety of products, but especially a skin treatment regime, that maintains each of the component compositions together in a unit to avoid separation and misplacement within a consumer's home.

SUMMARY OF THE INVENTION

A dual compartment pump dispenser is provided for storing different compositions to be delivered non-simultaneously but eventually functioning together to achieve a desired result, the dispenser including:

(i) a first container having a top and a bottom end, the top end having an opening and the bottom end being closed;

(ii) a second container having a top and a bottom end, the top end having an opening and the bottom end being closed; and (iii) a pair of pump mechanisms each with a dispensing nozzle having an opening for emptying product from the respective containers positioned on the top end of each container, the dispensing nozzle openings being oriented at an angle from 60° to 180° apart from one another.

An important feature of the present invention is that the dispensing nozzle openings are oriented so that simultaneous pressing of both pump mechanisms is not suggested to a consumer. A manner for avoiding this orients the dispensing nozzle openings at an angle of at least 60° apart from one another. Preferably the openings are oriented at least 90°, most preferably 180° apart.

Preferably the first and second containers have respective fitted together complementary shaped first and second curvilinear surfaces extending from the respective top to bottom ends. The first curvilinear surface includes a trough-shaped elongated recess and an adjacent elongated ridge, each bisected by a common plane. The second curvilinear surface likewise includes a trough-shaped elongated recess and an adjacent elongated ridge, with each likewise being bisected by a common plane. When placed together the ridge of the second surface snugly mates with the recess of the first surface. Similarly the ridge of the first surface snugly mates with the recess of the second surface.

Both pumps are fitted with dip tubes. Insertion of the dip tube into the first container requires the first curvilinear surface because of the recess to sinusoidally bulge near the top end towards the second curvilinear surface. Since the dip tube is short, there is no interference in penetrating the lower part of the first container. This permits the lower part to concavely recede away from the second curvilinear surface near the bottom end. In complementary fashion, the second curvilinear surface has a ridge in the upper part of the second container to accommodate the dip tube. This allows the second curvilinear surface near the top end to concavely recede away from the first curvilinear surface. Although primarily intended for dispensing nozzles oriented apart from one another, the aforementioned features of the curvilinear surfaces may also be employed with dispensing nozzle openings oriented parallel to one another discharging in the same direction. For this embodiment, there may be employed a mechanism for simultaneously activating both pumps. Flow of product would then proceed through a single cap with a single spray nozzle having two openings, each separately discharging contents from the respective first and second containers.

A collar joins together the first and second container. A groove along a parameter of the dispenser at the top end serves as an anchoring structure for a series of tongues, preferably six tongues, directed inwardly and formed on a lower edge of the collar. The arrangement of groove and tongues allows for ready removal of the pumping mechanisms from the containers. Unimpaired access to each container is thereby achieved. Remnants of product can therefore be more readily drained. Refill of product is also assisted by the removable collar arrangement.

The collar further includes a deck covering an upper end thereof. The deck is traversed by a pair of passageways. Downwardly projecting sleeves surround each of the passageways on an undersurface of the deck. An annular bead is formed along an interior wall of each sleeve. The pumps with their respective stems are inserted through the sleeves and via the annular bead are held tightly in place.

An overcap can be placed over the pumps. The overcap has a closed roof, an open floor, a circumferential sidewall and two windows distant from one another formed into the side walls. Preferably each of the containers and pumps are of a different color. The preferred embodiment is for the containers to have white and black color, respectively. The overcap is best formed of a transparent plastic. The visual aesthetics of black and white pumps is accentuated by transparency of the overcap. Nozzles of the pumps are accommodated through the windows in the overcap.

BRIEF DESCRIPTION OF THE DRAWING

The above features, advantages and objects of the present invention will more fully be appreciated through the following detailed discussion, reference being made to the drawing in which.

DETAILED DESCRIPTION OF THE INVENTION

Figure 1:
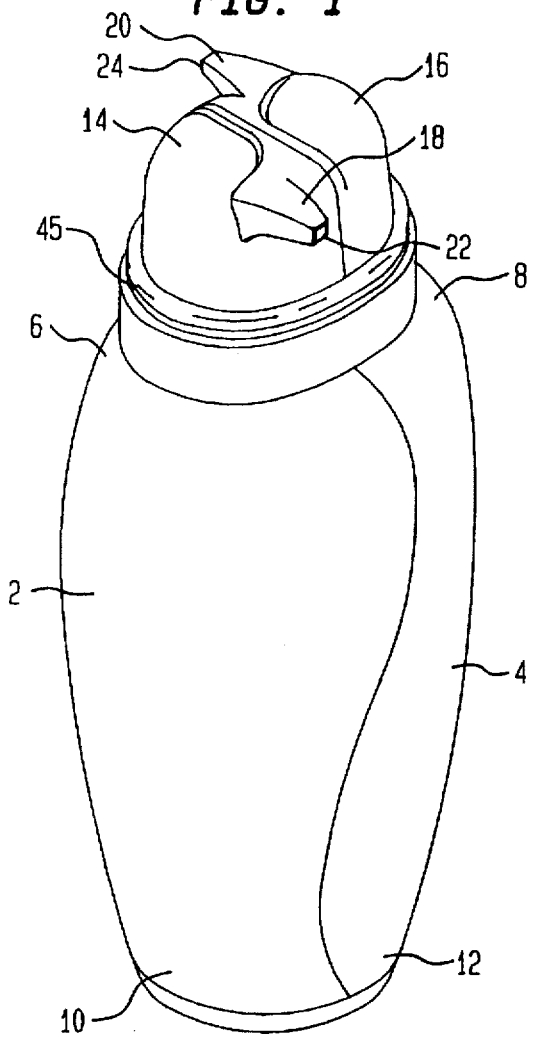
FIG. 1 is a front perspective view of a preferred embodiment of the dual compartment pump dispenser according to the present invention.
Figure 2:
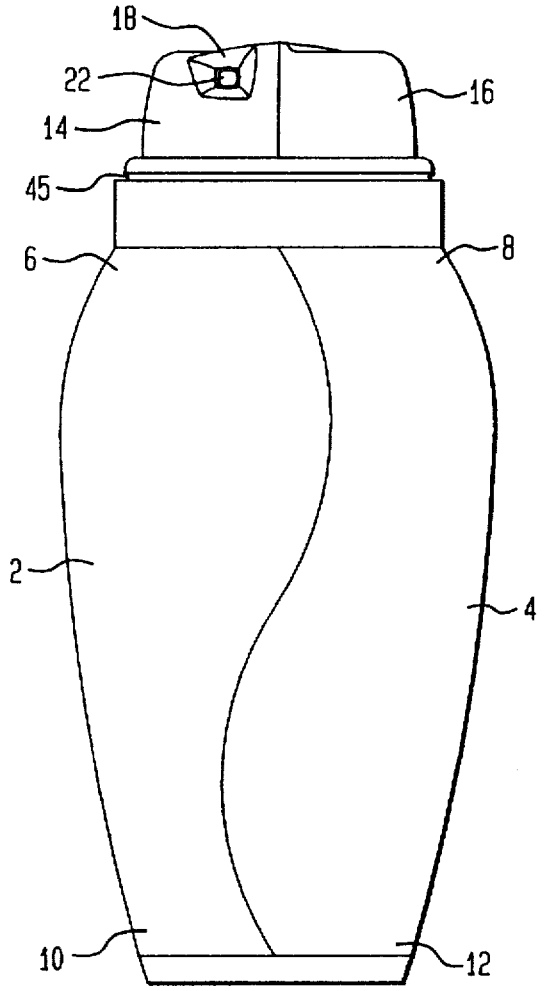
FIG. 2 is a front elevational view of the dispenser according to FIG. 1.

FIG. 1 illustrates a preferred embodiment of the present invention. This embodiment of the dispenser includes a first and second container 2, 4 having respective first and second top ends 6, 8 and first and second bottom ends 10, 12. The top ends are open and the bottom ends are closed. First and second pump mechanism 14, 16 with respective dispensing nozzles 18, 20 having dispensing openings 22, 24 are positioned over the top ends of their respective containers. Openings 22, 24 of the dispensing nozzles are oriented in a direction 180° opposite one another.

Figure 4:
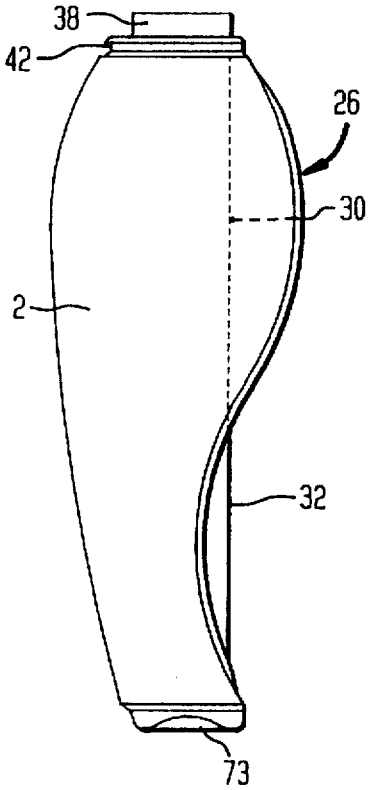
FIG. 4 is the left hand container of the dual compartment pump dispenser shown in FIG. 2.
Figure 5:
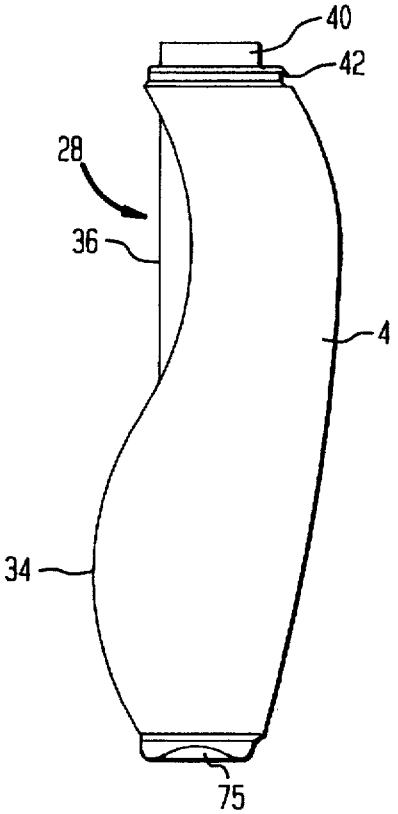
FIG. 5 is the right hand container of the dual compartment pump dispenser shown in FIG. 2.

FIGS. 4 and 5 best illustrate joinder of the first and second containers 2, 4 along respective curvilinear surfaces 26, 28.

Figure 6:
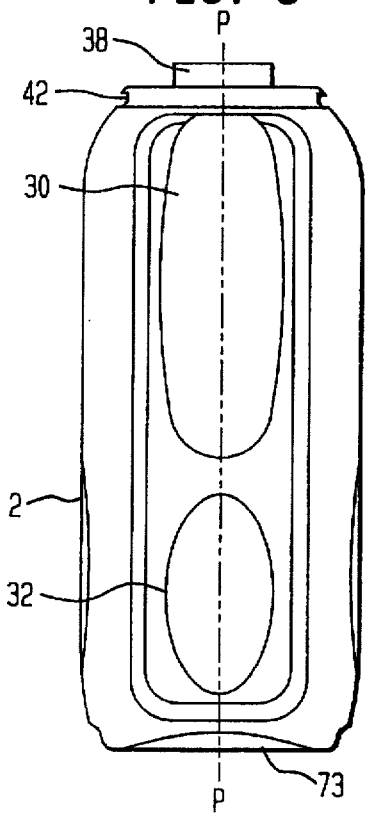
FIG. 6 is a right side elevational view of the container in FIG. 4 showing the curvilinear surface.
Figure 7:
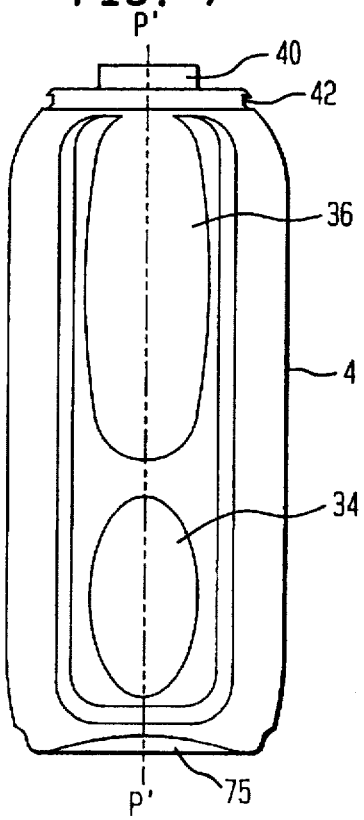
FIG. 7 is a left side elevational view of the container in FIG. 5 showing the curvilinear surface.

These curvilinear surfaces are complementary-shaped to fit together along a length of the containers from top to bottom ends. Features of the curvilinear surfaces are best illustrated in FIGS. 6 and 7. Curvilinear surface 26 includes a trough-shaped elongated recess 30 and an adjacent elongated ridge 32, each bisected by a common plane P. Second curvilinear surface 28 also includes a trough-shaped elongated recess 34 and an adjacent elongated ridge 36, each being bisected by a common plane P'. Recess 30 on the first curvilinear surface 26 snugly mates with the ridge 36 of the second curvilinear surface 28. Likewise, recess 34 of the second curvilinear surface mates with ridge 32 of the first curvilinear surface. These combinations of structures along the sinusoidal mating surfaces ensure tight fit between the pair of first and second containers.

Figure 3:
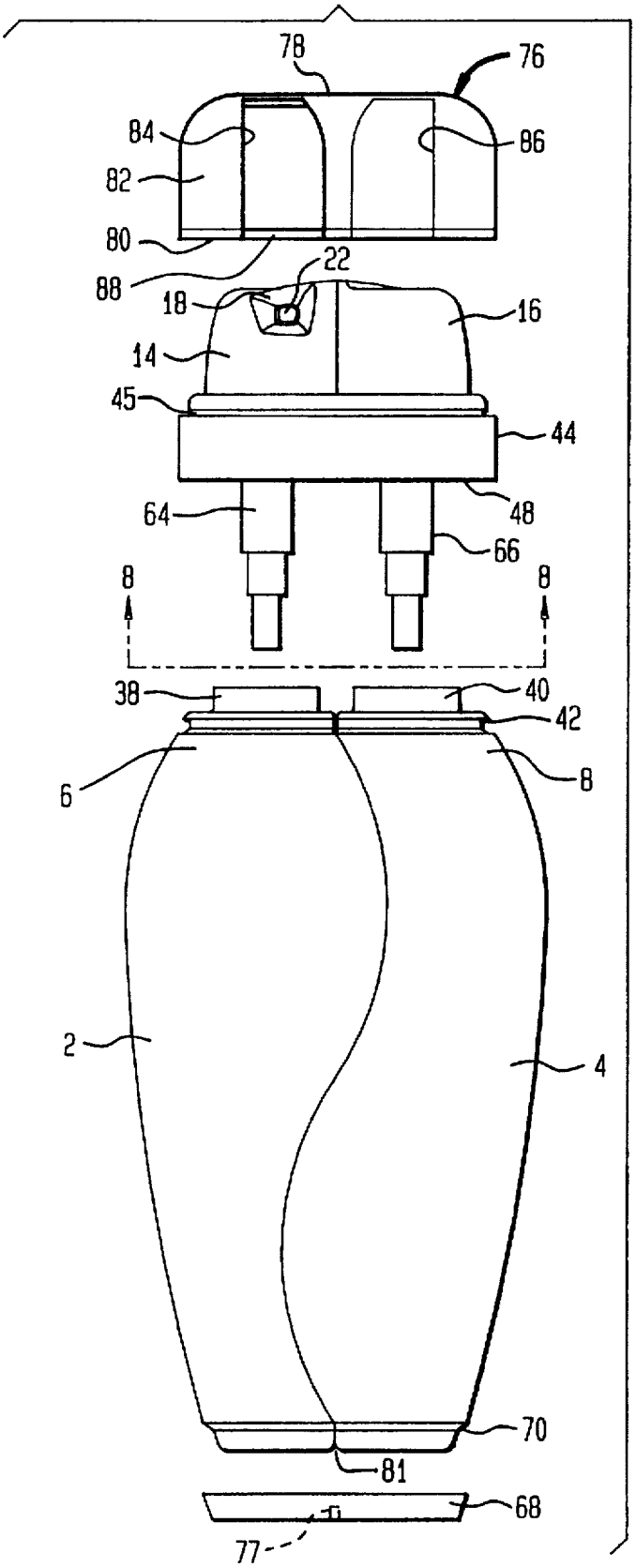
FIG. 3 is an exploded view of the dispenser including an overcap.
Figure 8:
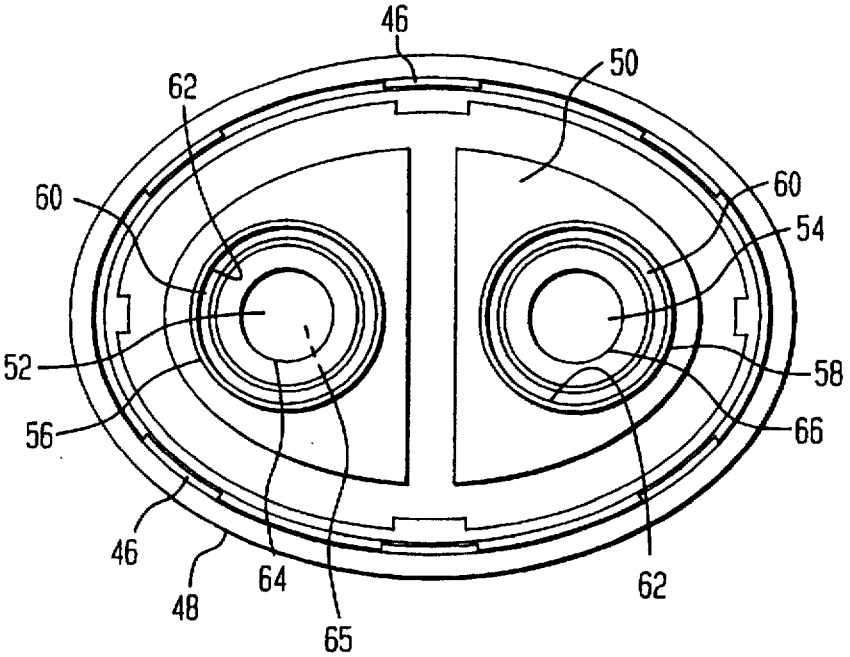
FIG. 8 is a bottom view of the pump and collar assembly as seen along line 8—8 of FIG. 3.

FIG. 3 illustrates the dispenser separated into its major components. Top ends 6, 8 of the containers are surmounted with respective necks 38, 40. Around each neck is a groove 42 with both grooves aligned forming a continuous system along an upper perimeter of the dispenser. A collar 44 joins together the first and second containers. Along a periphery of an upper edge of the collar is formed a channel 45. A series of inward projecting tongues 46 are formed at a lower edge 48 of the collar. These are best viewed in FIG. 8. These tongues are engageable within groove 42 to fasten together the first and second container at their top ends.

The collar 44 further includes a deck 50 covering an upper end thereof. A pair of passageways 52, 54 and downward projecting sleeves 56, 58 are formed as part of the deck. An annular bead 60 protrudes from an interior wall 62 of the sleeves. Pump mechanisms 14, 16 have respective stems 64, 66 which are inserted through the sleeves 56, 58. The respective annular bead 60 forces the stems to be tightly held in place. Product leakage across the stems and through the passageways is prevented by a gasket 65 placed around each respective stem at an upper end thereof.

Figure 9:
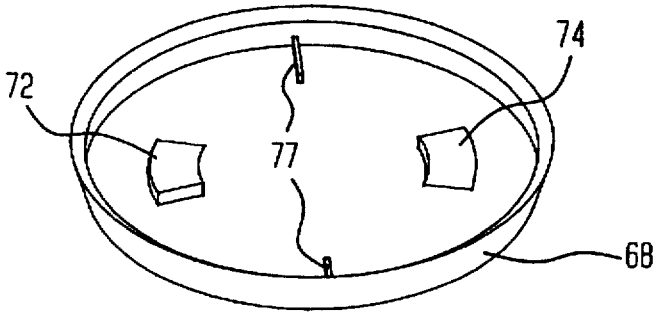
FIG. 9 is a top elevational view of the base cup.

FIG. 9 best illustrates a base cup 68 which snaps onto a circumferential indentation at the bottom ends 10, 12 of the joined containers. A pair of slightly curved ramps 72, 74 protrude upward from an inner surface of the base cup. These ramps are engageable with D-shaped indentations 73, 75 on respective bottom ends of the first and second containers. Additionally a pair of orienting ridges 77 are molded on the inner surface of the base cup. The ridges are positioned opposite one another along a circumference of the base cup and each is equidistant from the respective curved ramps. These ridges are intended to fit within a small gap 81 found between surfaces 26 and 28 at a lower end of the containers.

First and second containers and the outer surfaces of their respective pump mechanisms, in the preferred embodiment, are colored white and black, respectively. These colors accentuate the dual nature and purpose of the multi-container dispenser.

FIG. 3 illustrates overcap 76 having a closed roof 78, an open floor 80, a circumferential sidewall 82 and a pair of windows 84, 86 distant from one another formed into the sidewall. Overcap 76 shields the pump mechanisms from inadvertent activation and can snap into channel 45 formed along the upper surface of the collar 44. A bead 88 along a lower margin of the overcap ensures retention of the overcap within the channel. In the preferred embodiment the overcap is produced as a transparent plastic to sharpen a consumer awareness toward the difference between each container, and thereby the difference between the contents of each.

Although this invention has been described with reference to a specific embodiment, it will be apparent to one skilled in the art that various modifications may be made thereof which fall within the scope and purview of the invention.

What is claimed is:

1. A dual compartment pump dispenser comprising:

(i) a first container having a top and a bottom end, the top end having an opening and the bottom end being closed;

(ii) a second container having a top and a bottom end, the top end having an opening and the bottom end being closed; and (iii) a pair of pump means each with a dispensing nozzle having an opening for emptying product from the respective containers positioned on the top end of each container, the dispensing nozzle openings being oriented at an angle from 60° to 180° apart from one another, the first and second containers having respective complementary shaped first and second curvilinear surfaces fitted together extending from the respective top to bottom ends, and the first curvilinear surface including a trough-shaped elongated recess and an adjacent elongated ridge each bisected by a common plane.

2. The dispenser according to claim 1 further comprising an overcap having a closed roof, an open floor, a circumferential sidewall and two windows distant from one another formed into the sidewall.

3. The dispenser according to claim 1 further comprising a base cup having means unitarily formed therein for separately engaging the bottom end of each of the first and second containers, the base cup covering both bottom ends.

4. The dispenser according to claim 1 wherein the second curvilinear surface includes a trough-shaped elongated recess and an adjacent elongated ridge each bisected by a common plane, the ridge of the second curvilinear surface snugly mating with the recess of the first curvilinear surface.

5. The dispenser according to claim 4 wherein the first curvilinear surface sinusoidally bulges toward the second curvilinear surface near the top end and concavely recedes away from the second curvilinear surface near the bottom end.

6. The dispenser according to claim 1 further comprising a collar joining together the first and second containers.

7. The dispenser according to claim 6 further comprising a groove along a perimeter of the dispenser at the top end.

8. The dispenser according to claim 7 wherein the collar at a lower edge thereof includes a series of inwardly projecting tongues engageable within the groove to fasten together the first and second containers.

9. The dispenser according to claim 1 where each container is of a different color.

10. The dispenser according to claim 9 wherein one container is white and the other is black.

11. A dual compartment pump dispenser comprising:

(i) a first container having a top and a bottom end, the top end having an opening and the bottom end being closed;

(ii) a second container having a top and a bottom end, the top end having an opening and the bottom end being closed, the first and second containers having respective complementary shaped first and second curvilnear surfaces fitted together extending from the respective top to bottom ends, the first curvilinear surface including a trough-shaped elongated recess and an adjacent elongated ridge each bisected by a common plane; and (iii) a pair of pump means each with a dispensing opening for emptying product from the respective containers positioned on top of each container.

12. The dispenser according to claim 11 further comprising a base cup having means unitarily formed therein for separately engaging the bottom end of each of the first and second containers, the base cup covering both bottom ends.

13. The dispenser according to claim 11 wherein the second curvilinear surface includes a trough-shaped elongated recess and an adjacent elongated ridge each bisected by a common plane, the ridge of the second curvilinear surface snugly mating with the recess of the first curvilinear surface.

14. The dispenser according to claim 13 wherein the first curvilinear surface sinusoidally bulges toward the second curvilinear surface near the top end and concavely recedes away from the second curvilinear surface near the bottom end.

15. A dual compartment pump dispenser comprising:

(i) a first container having a top and a bottom end, the top end having an opening and the bottom end being closed;

(ii) a second container having a top and a bottom end, the top end having an opening and the bottom end being closed;

(iii) a pair of pump means each with a dispensing nozzle having an opening for emptying product from the respective containers positioned on the top end of each container, the dispensing nozzle openings being oriented at an angle from 60° to 180° apart from one another; and (iv) a collar joining together the first and second containers and a groove along a perimeter of the dispenser at the top end, the collar at a lower edge thereof including a series of inwardly projecting tongues engageable with the groove to fasten the first and second containers.

16. The dispenser according to claim 15 wherein the first and second containers have respective complementary shaped first and second curvilinear surfaces fitted together extending from the respective top to bottom ends.

17. The dispenser according to claim 16 wherein the first curvilinear surface includes a trough-shaped elongated recess and an adjacent elongated ridge each bisected by a common plane.

18. The dispenser according to claim 15 wherein the collar further comprises a deck covering an upper end thereof.

19. The dispenser according to claim 18 wherein the deck further comprises a pair of passageways and downward projecting sleeves with an annular bead formed along an interior wall of the sleeves.

20. The dispenser according to claim 19 wherein the pump means have respective stems inserted through the sleeves and via the annular bead are tightly held in place.

21. A dual compartment pump dispenser comprising:

(i) a first container having a top and a bottom end, the top end having an opening and the bottom end being closed;

(ii) a second container having a top and a bottom end, the top end having an opening and the bottom end being closed;

(iii) a pair of pump means each with a dispensing nozzle having an opening for emptying product from the respective containers positioned on the top end of each container, the dispensing nozzle openings being oriented at an angle from 60° to 180° apart from one another; and (iv) a collar joining together the first and second containers and including a deck covering an upper end thereof.

22. The dispenser according to claim 21 wherein the overcap is formed of a transparent material.

23. A dual compartment pump dispenser comprising:

(i) a first container having a top and a bottom end, the top end having an opening and the bottom end being closed;

(ii) a second container having a top and a bottom end, the top end having an opening and the bottom end being closed;

(iii) a pair of pump means each with a dispensing nozzle having an opening for emptying product from the respective containers positioned on the top end of each container, the dispensing nozzle openings being oriented at an angle from 60° to 180° apart from one another; and (iv) an overcap having a closed roof, an open floor, a circumferential sidewall and two windows distant from one another formed into the sidewall.

* * * * *